United States Patent [19]

Shepard

[11] Patent Number: 4,586,745

[45] Date of Patent: May 6, 1986

[54] SKI SLING

[76] Inventor: John S. Shepard, 1304 S. Shields, Ft. Collins, Colo. 80521

[21] Appl. No.: 254,886

[22] Filed: Apr. 16, 1981

[51] Int. Cl.[4] ..... B65P 45/04

[52] U.S. Cl. ..... 294/150; 294/151; 294/152

[58] Field of Search ..... 294/150, 151, 152, 153, 294/74, 17 EA, 67 BA; 248/60, 74 B

[56] References Cited

U.S. PATENT DOCUMENTS 1,699,114 1/1929 Meagher ..... 294/151

2,485,864 10/1949 Cohen et al. ..... 294/152

3,268,134 8/1966 Baston et al. ..... 294/150

*Primary Examiner*—James B. Marbert

*Attorney, Agent, or Firm*—Hugh H. Drake

[57] ABSTRACT

A ski sling is composed of first and second elongated hollow tubes, the first being the longest and the second being sized to fit within the first. A continuous loop, of adjustable length, of flexible cord runs in series through the interiors of those tubes. The length of the cord is sufficient to enable opposite sides of the loop to be wrapped around a pair of skis with the first tube tucked back between the opposite sides and spaced above the second tube in order to form a sling.

4 Claims, 3 Drawing Figures

SKI SLING

The present invention pertains to a ski sling. More particularly, it relates to a sling which is capable of being pocketed by the user when not in use.

When not in use, a pair of skis, and also their associated equipment, may prove to be unwieldy for carrying from one place to another. Being long but comparatively thin, it can become difficult to grasp the pair of skis at exactly the right point so that they stay in balance while a single hand supports them in suspension. Add to that a pair of ski poles also being carried by the same hand, the user may have understandable difficulty in keeping all parts pointed in the same direction. The obvious problem arises because the skis often are six or seven feet in length and yet they may be only a few inches in width.

The problem is somewhat similar to that in carrying a bundle of wood. Thus, U.S. Pat. No. 3,119,160-Hoppeler discloses the use of a particular kind of sling for wrapping such a bundle and enabling the user to carry it by means of a handle that extends between a pair of opposing cords looped around the bundle of wood. U.S. Pat. No. 466,670-Fler even adapted the sling approach for the carrying of an awkward shape such as a melon. Those approaches, however, did not solve the problem of clamping a sling to slippery skis.

The problem, as specifically adapted to skis, is not unrecognized. See, for example, U.S. Pat. Nos. 3,268,134-Baston et al, 3,830,416-Smedley, 3,960,302-Mazzoni, and 4,055,287-Champenoi, Jr.. The approaches of Smedley and Mozzoni are sort of like the handle on a suitcase. They require carrying the skis at a lower elevation than the hand of the user, also allowing the skis and/or ski poles to swing around and otherwise become a bother. Thwarting that, the approaches of Baston et al and Champenoi allow the obtaining of a firm grasp upon the skis being carried. In achieving that worthwhile result, however, the resultant carrier becomes bulky and cumbersome.

It is, accordingly, a general object of the present invention to provide a new and improved ski sling which may achieve certain objectives of the aforementioned references but yet which accomplishes the end result in a more efficacious manner.

A specific object of the present invention is to provide a new and improved ski sling which is capable of being stored, when not in use, readily within the pocket of the user.

A further object of the present invention is to provide a ski sling which is so constructed as to enable a most secure grasping of that which is carried.

In accordance with the present invention, a ski sling comprises a first elongated hollow tube of predetermined length and internal diameter. It cooperates with a second elongated hollow tube that has a length which is less than that predetermined length and has an external diameter less than that predetermined internal diameter. An effectively continuous loop of flexible cord runs in series through the interiors of the first and second tubes. The length of the cord is sufficient to enable opposite sides of the loop to be wrapped around a pair of skis with the first tube tucked back between the opposite sides and spaced above the second tube to form a sling. Related features enable compact storage when the device is not in use.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
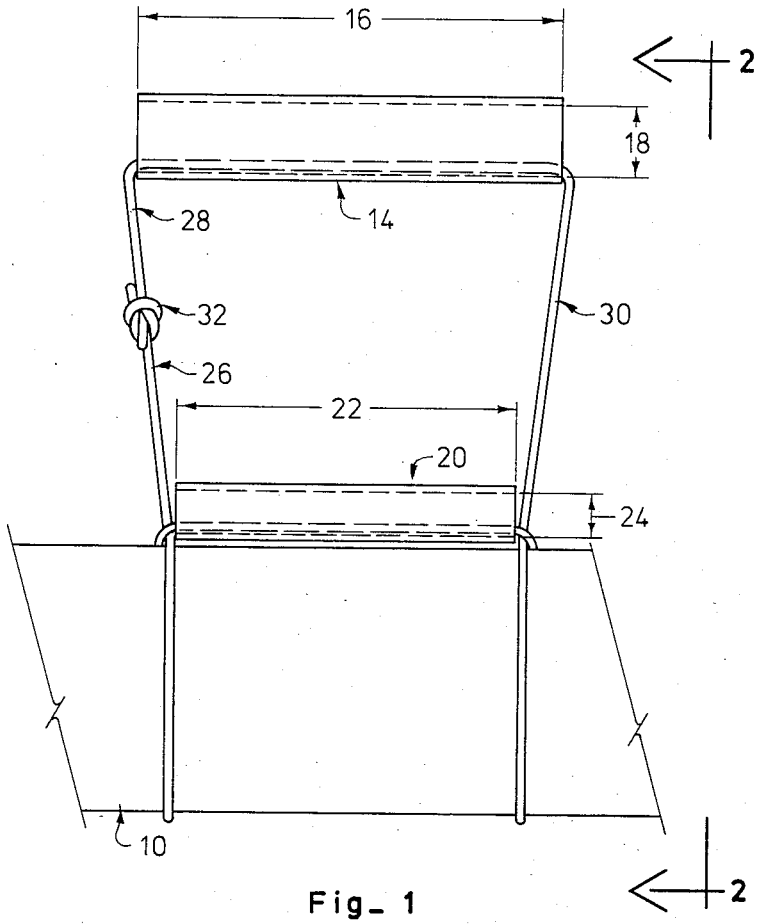
FIG. 1 is a fragmentary side elevational view of a ski sling carrying a pair of skis.
Figure 2:
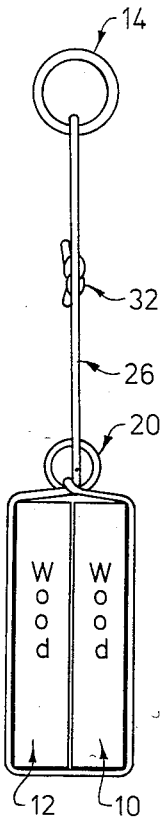
FIG. 2 is an end elevational view taken along the line 2—2 in FIG. 1.

A pair of skis 10 and 12 are to be carried. A first elongated hollow tube 14 is of predetermined length 16 and internal diameter 18. A second elongated hollow tube 20 is of a length 22 that is less than length 16. Tube 20 also has an external diameter 24 that is less than the internal diameter 18 of tube 14.

An effectively continuous loop 26, of nylon cord or the like, runs in series through the interiors of tubes 14 and 20. The length of cord 26 is sufficient as to enable opposite sides of that loop to be wrapped around skis 10 and 12 with tube 14 tucked back between its opposite sides 28 and 30 and spaced above tube 20 so as to form a sling. It will be observed that the opposite ends of loop 26 of the cord are removably secured together, as at knot 32, to enable formation of the loop and adjustment of the total length thereof. The cord has to be laterally bendable. I also may be resiliently extensible, although that is not a requirement.

Figure 3:
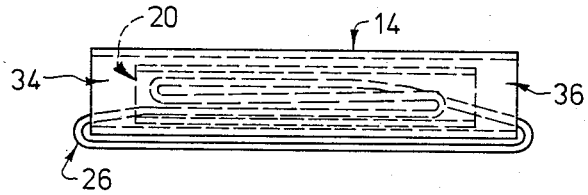
FIG. 3 is a front elevational view of the ski sling of FIGS. 1 and 2 removed from the skis and compacted for storage or carrying.

The external diameter of tube 20 is sufficiently less than the internal diameter 18 of tube 14 as to enable telescoping of tube 20 within tube 14, while yet allowing a portion of loop 26 to be disposed between those tubes 14 and 20. Moreover, it is preferable that the internal diameter of tube 20, together with the difference in lengths of the tubes, is sufficiently large to enable stuffing the remainder of loop 26 within the telescoped assembly of tubes 14 and 20 for storage. As shown in FIG. 3, the internal diameter of tube 20 is sufficiently large to enable storage of the remainder of the cord inside that tube 20. On the other hand, all or part of the storage can be accommodate outside of tube 20 but inside the space left within tube 14 as at the opposite ends of tube 20 designated by the numerals 34 and 36 in FIG. 3.

Because tube 20 is of lesser length than tube 14, the portion of cord 26 that extends from tube 20 captivates or locks the cord into a tight binding of the carried skis or other elements as a result of the remainder of cord 26 having to flare outwardly to what becomes a handle formed by tube 14. For ultimate advantage, therefore, it is preferred that one tube is sufficiently longer than the other so that the cord is caused to lock into place about the skis, ski poles or the objects being carried. At the same time, tube 20 enforces a spacing between the cord portions wrapped around the skis. That keeps those portions from sliding together.

Of course, knot 32 could be replaced by some kind of adjustable but yet quick-disconnect fastener. One objective of such adjustability is to allow adaptation as to different kinds of skis or other carried objects, such as ski boots, and a difference in number as to what is being carried at any time. Thus, the ultimate objective is to enable holding the carried objects at about the level of the hand or at least no lower than to accommodate the insertion of the hand into and around the loop carrier system.

Whether storage of the spare cord, for pocketing, is achieved by being able to insert parts of the cord within the inner tube, when the two tubes are telescoped, is not believed to be important. Such storage, as indicated, might as well be accommodated within the ends of the outer tube and just beyond the ends of the inner tube. Whichever, that part of the concept is to "bury" the cords within the assembly as telescoped for the convenience of the user who wishes to put it all within his pocket while not using the overall device for its carrying purpose.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A ski sling comprising:

a first elongated hollow tube of predetermined length and internal diameter;

a second elongated hollow tube of a length less than said predetermined length and an external diameter less than said predetermined internal diameter;

and an effectively continuous loop of flexible cord running lengthwise in series through the hollow interiors of said first and second tubes, the length of said cord being sufficient to enable opposite sides of said loop to be wrapped around a pair of skis with said first tube tucked back between said opposite sides and spaced above said second tube to form a sling.

2. A ski sling comprising:

a first elongated hollow tube of predetermined internal diameter;

a second elongated hollow tube of an external diameter less than said predetermined internal diameter;

and an effectively continuous loop of flexible cord running lengthwise in series through the hollow interiors of said first and second tubes, the length of said cord being sufficient to enable opposite sides of said loop to be wrapped around a pair of skis with said first tube tucked back between said opposite sides and spaced above said second tube to form a sling.

3. A ski sling as defined in claims 1 or 2 in which the external diameter of said second tube is sufficiently less than said predetermined internal diameter to enable telescoping of said second tube within said first tube with a portion of said loop disposed between said first and second tube.

4. A ski sling as defined in claim 3 in which the internal diameter of said second tube together with the difference in lengths of said tubes is sufficiently large to enable stuffing the remainder of said loop within the telescoped assembly of said first and second tubes.

* * * * *